United States Patent [19]

Monheim

[11] Patent Number: 4,995,578

[45] Date of Patent: Feb. 26, 1991

[54] APPARATUS AND METHOD FOR SECURING A TUBULAR WORKPIECE IN POSITION ON A SUPPORT

[76] Inventor: Donald P. Monheim, N22 W28843 Oak La., Pewaukee, Wis. 53072

[21] Appl. No.: 514,717

[22] Filed: Apr. 26, 1990

[51] Int. Cl.[5] ..... E06C 7/14

[52] U.S. Cl. ..... 248/210; 182/129

[58] Field of Search ..... 248/210, 211; 182/129, 182/181

[56] References Cited

U.S. PATENT DOCUMENTS

| | | | |
|---|---|---|---|
| 3,887,034 | 6/1975 | Sawatzky . | |
| 4,222,541 | 9/1980 | Cillis | 248/210 |
| 4,318,454 | 3/1982 | Johnson . | |
| 4,533,091 | 8/1985 | Knight | 248/210 |
| 4,580,660 | 4/1986 | Oling . | |
| 4,589,521 | 5/1986 | Finster et al. . | |
| 4,638,885 | 1/1987 | Frederick | 182/181 |
| 4,660,794 | 4/1987 | Given . | |
| 4,676,468 | 6/1987 | Preston et al. . | |
| 4,702,446 | 10/1987 | Brown . | |
| 4,706,918 | 11/1987 | Wilson . | |
| 4,776,550 | 10/1988 | Storey . | |
| 4,787,586 | 11/1988 | Crain . | |
| 4,823,912 | 4/1989 | Gould et al. . | |

*Primary Examiner*—Reinaldo P. Machado

*Attorney, Agent, or Firm*—Andrus, Sceales, Starke & Sawall

[57] ABSTRACT

An apparatus and method for maintaining a tubular workpiece in position on a support, such as a ladder or the like, preferably comprises a pair of bodies adapted for connection to the support, with one of the bodies being positioned on either side thereof, such as to the stiles of the ladder. A clamping assembly including a clamping plate secures the bodies to the ladder stiles in a predetermined position on the ladder and at a predetermined angular orientation. Each body is provided with an upwardly facing slot having a width which decreases toward the lower portion of the body, with the slots being adapted to receive the workpiece therein. Downward movement of the workpiece into the slots results in frictional engagement of the workpiece with the slot walls to secure the workpiece in position. The workpiece is removed by exerting an upward force thereon and disengaging the workpiece from the slot walls.

10 Claims, 1 Drawing Sheet

FIG. 1
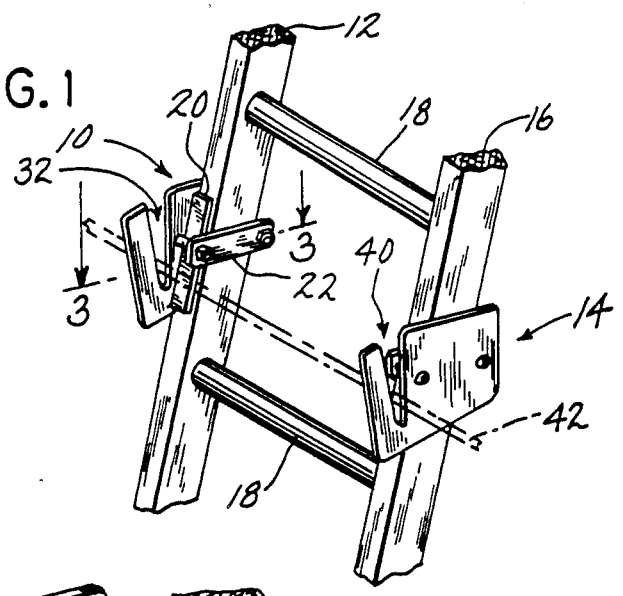
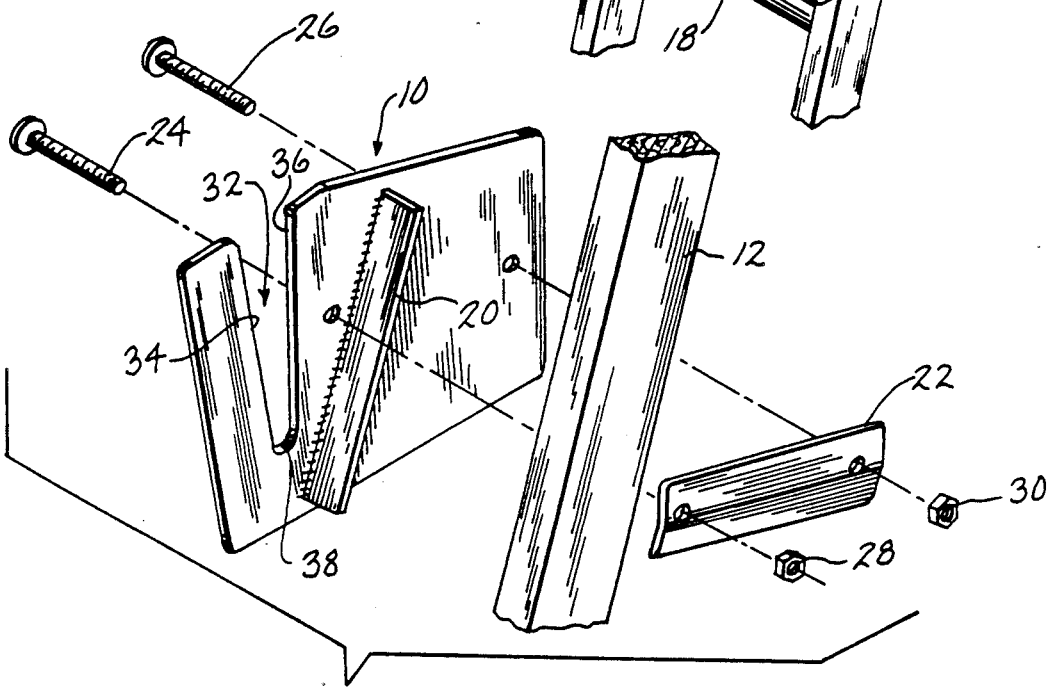
FIG. 2
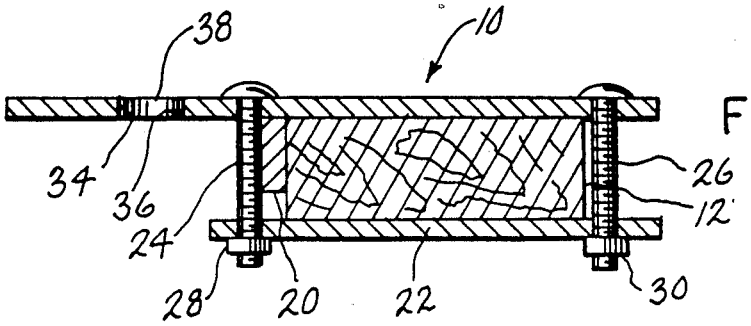
FIG. 3

APPARATUS AND METHOD FOR SECURING A TUBULAR WORKPIECE IN POSITION ON A SUPPORT

BACKGROUND AND SUMMARY

This invention relates to tools, and more particularly to a device for maintaining a tubular workpiece in position on a support, such as a ladder.

Various accessories are known for use in connection with a ladder for supporting an object on the ladder. For example, numerous prior art patents disclose various structures for maintaining a paint can or the like in a position where it is readily accessible by a person standing on the ladder.

The present invention also has as its object to maintain an article in position on a support such as a ladder or the like. More specifically, the invention is designed to maintain a tubular workpiece such as an electrical conduit, pipe or other such article, in position on a support such as a ladder. A further object of the invention is to provide a device which allows a workpiece to be temporarily maintained in position on the support, and which provides quick and easy placement of the workpiece into position and rapid removal of the workpiece after completion of an operation being performed on the workpiece.

In accordance with the invention, a device for maintaining a workpiece in position on a support such as a ladder or the like comprises a body adapted for connection to the support, such as the stile of the ladder. Stationary retainer means is provided on the body for receiving the workpiece and fixing its position relative to the support. In a preferred embodiment, the stationary retainer means comprises an upwardly facing tapered slot, with the open top end of the slot having a transverse dimension greater than the largest transverse dimension of the workpiece. This arrangement allows downward movement of the workpiece into the slot. The taper of the slot provides a decreasing transverse dimension to the slot from the top of the slot toward the bottom of the slot. The least transverse dimension of the slot is less than the transverse dimension of the object inserted therein, so that downward movement of the object into the slot causes engagement of opposing sides of the object with the walls of the slot. In this manner, the object is firmly held onto the body by engagement with the walls of the slot, and the desired operation, such as cutting, drilling, threading or the like, can be performed on the object. Thereafter, the object is removed from the slot simply by application of an upward force on the object, which dislodges the object from engagement with the walls of the slot, allowing removal of the object therefrom by passing the object upwardly through and out of the slot.

In a preferred embodiment, the invention comprises a pair of body portions, each of which is adapted for engagement to one of the ladder stiles. Each body portion is provided with a slot as described. Accordingly, the tubular workpiece must have a length greater than the width of the ladder, enabling it to span between the two spaced body portions secured to the ladder stiles.

The invention further contemplates a method of maintaining a tubular workpiece in position on a support such as a ladder or the like, substantially in accordance with the foregoing summary.

BRIEF DESCRIPTION OF THE DRAWINGS

The drawings illustrate the best mode presently contemplated of carrying ut the invention.

In the drawings:

FIG. 1 is a partial isometric view showing the device of the invention in place on a ladder, with the body portions being secured one to either stile of the ladder;

FIG. 2 is an exploded isometric view showing connection of one of the body portions to a stile of a ladder; and FIG. 3 is a section view taken generally along line 3—3 of FIG. 1.

DETAILED DESCRIPTION OF THE PREFERRED EMBODIMENT

Referring to FIG. 1, a retainer device for maintaining a tubular workpiece in position comprises a first body 10 adapted for connection to a stile 12 of a ladder, and a second body 14 adapted for connection to the other stile 16 of the ladder. As shown, a series of treads 18 extend between ladder stiles 12, 16. Bodies 10, 14 are substantially mirror images of each other in construction, and identical in operation.

Referring to FIG. 2, body 10 comprises a substantially planar member having a rearward portion for mounting to ladder stile 12 and a forward portion extending forwardly therefrom. A guide plate 20 is connected to and extends perpendicularly outwardly from the rearward portion of body 10. As shown in FIGS. 1 and 3, guide plate 0 is adapted for placement against the forward face of ladder stile 12, and the inner surface of body 10 is adapted for placement against the outer side portion of ladder stile 12.

As a means for retaining body 10 in position on ladder stile 12, a clamping plate 22 is adapted for placement against the inner side portion of ladder stile 12 opposite the side portion of ladder stile 12 engaged by the inner surface of body 10. A pair of bolts 24, 26 are inserted through openings formed in body 10 and clamping plate 22. The openings in body 10 and clamping plate 22 are spaced an equal distance apart, with the distance being greater than the depth of ladder stile 12. In this manner, when bolts 24, 26 are inserted through the openings in body 10 and clamping plate 22, bolt 24 is positioned so as to be spaced forwardly from the forward face of ladder stile 12 and bolt 26 is spaced rearwardly from the rear face of ladder stile 12, so that bolts 24, 26 straddle stile 12. Threaded nuts 28, 30 are adapted for engagement with the threaded portions of bolts 24, 26, as is known, and satisfactory washers (not shown) are provided adjacent nuts 28, 30. After bolts 24, 26 are in position in the openings through body 10 and clamping plate 22, nuts 28, 30 are turned down on bolts 24, 26 so as to draw clamping plate 22 toward body 10, acting to clamp ladder stile 12 therebetween. Imparting a satisfactory amount of torque to bolts 28, 30 firmly and securely affixes body 10 to ladder stile 12 so as to maintain it in a desired position on ladder stile 12. Guide plate 20 functions to ensure that body 10 is secured to ladder stile 12 in a desired predetermined angular orientation relative to stile 12.

As noted previously, body 14 has a construction which is a mirror image of body 10, and is secured to ladder stile 16 in an identical manner to that in which body 10 is secured to ladder stile 12.

Referring to FIGS. 1 and 2, the forward portion of body 10 is provided with an upwardly facing tapered slot 32 defined by opposed slot walls 34, 36. Slot 32 opens onto the top edge of body 10, and provides a greater transverse dimension at its mouth than at its inner end, shown at 38, which is disposed toward the lower end of body 10. Slot walls 34, 36 are substantially linear from the mouth of slot 32 to its end 38, thereby providing a gradual decreasing taper to slot 32 in a direction from the top of body 10 toward the bottom of body 10. In the illustrated embodiment, the mouth of slot 32 has a transverse dimension of 1 ¼ inches, and the transverse dimension of slot 32 adjacent its end 38 is ⅝ inch.

Body 14, being a mirror image of body 10, is provided with a slot 40 essentially identical in construction to that of slot 32 formed in body 10.

In operation, a tubular workpiece (shown in phantom in FIG. 1 at 42), which may be a length of electrical conduit, pipe or the like, is maintained in position on the ladder by inserting workpiece 42 into the mouths of slots 32, 40 formed in bodies 10, 14, respectively. The mouths of slots 32, 40 have a width sufficient to receive workpiece 42 therein. Workpiece 42 is moved downwardly into slots 32, 40, until opposing surfaces of workpiece 42 are engaged by the walls of slots 32, 40. Once the workpiece is engaged by the slot walls, the user exerts a further downward force on workpiece 42 so as to provide secure frictional engagement of workpiece 42 with the walls of slots 32, 40, for securely and firmly retaining workpiece 42 in position on bodies 10, 14, and thereby on the ladder. The user then performs a desired operation on workpiece 42, such as cutting it to a predetermined length, fitting it with threads or the like, or any other satisfactory operation as desired. After the desired operation has been performed on workpiece 42, the user exerts an upward force on workpiece 42 so as to break the frictional engagement of workpiece 42 with the walls of slots 32, 40. The user then moves workpiece 42 upwardly out of slots 32, 40, completely removing workpiece 42 therefrom.

With the construction as shown and described, a simple and effective device and method is provided for maintaining a workpiece in position on a ladder or the like. The bodies are provided one on either stile of the ladder, therefore not interfering with movement of the user up and down the ladder on treads 18. The bodies can be quickly and easily disengaged from the ladder stiles and moved to a different position, for accommodating varying heights at which the user is working, or for complete removal from the ladder. The workpiece is retained in position by a stationary clamping system, thereby eliminating any moving parts which would otherwise be required to securely engage the workpiece and retain it in position.

It is contemplated that sets of body 10, 14 can be provided for accommodating different widths of workpieces. For example, when a user is working with larger conduit or pipe, a set of bodies having larger slots can be used, according to the size of the workpiece being employed. When the user has completed work with the larger workpiece, a different set of bodies can be mounted to the ladder for accommodating a different size of workpiece. Due to the simple construction of the bodies, the cost of the bodies is relatively low, and it is contemplated that a construction worker or other person would be able to accommodate most commonly employed sizes of conduit or pipe by keeping 2 or 3 sets of bodies on hand.

It has been found that orienting slot walls 34, 36 so that they define an acute included angle of approximately 9° provides satisfactory engagement of the workpiece by the slot walls. It is contemplated, however, that a greater or lesser angle could be employed, but the angle should not be so great as to materially reduce the ability of the workpiece to be maintained within the slot, which may occur if the angle defined by the slot is too great.

Various alternatives and embodiments are contemplated as being within the scope of the following claims particularly pointing out and distinctly claiming the subject matter regarded as the invention.

I claim:

1. A device for maintaining a workpiece in position on a support, comprising:
   a body;
   clamping means for affixing said body to said support; and
   stationary retainer means provided on said body for engaging said workpiece and fixing the position of said workpiece relative to said support, said retainer means comprising an upwardly facing slot formed in said body and adapted to receive said workpiece therein, said slot being provided with a decreasing transverse dimension toward the lower portion of said body so that downward movement of said workpiece in said slot causes engagement of said workpiece with the walls of said slot.

2. The device of claim 1, wherein each said body comprises a substantially planar member adapted for placement against a side of said support, and wherein said clamping means comprises a clamping plate adapted for placement against another side of said support, and means extending between said body and said clamping plate for clamping said support therebetween and securing said body in position thereon.

3. The device of claim 2, wherein said means extending between said body and said clamping plate comprises a pair of threaded nut and bolt assemblies provided one on either side of said support for drawing said clamping plate toward said body and clamping said support therebetween.

4. The device of claim 2, further comprising guide means on said body for engaging said support to facilitate securing of said body to said support in a predetermined angular orientation relative to said support.

5. The device of claim 4, wherein said guide means comprises a guide plate extending outwardly from a surface of said body and adapted for placement against a surface of said support.

6. The device of claim 1, wherein said clamping means fixes a rearward portion of said body to said support, and wherein said slot is formed in a forward portion of said body projecting from the forwardmost surface of said support for fixing the position of said workpiece to said support at a location spaced forwardly therefrom.

7. The device of claim 6, wherein said support comprises a ladder or the like including a pair of spaced upright members, and wherein said first-mentioned body is adapted for connection to one of said upright members, and further comprising:
   a second body;
   clamping means for affixing said second body to the other said spaced upright members; and
   stationary retainer means provided on said second body for engaging said workpiece at a location spaced from said first-mentioned body, said stationary retainer means comprising an upwardly facing slot formed in a forward portion of said body and adapted to receive said workpiece therein, said slot being provided with a decreasing transverse dimension toward the lower portion of said second body so that downward movement of said workpiece in said slot causes engagement in said workpiece with the walls of said slot.

8. An assembly for maintaining a workpiece in position on a ladder or the like including a pair of spaced upright members, comprising:

a first body;

a second body;

first clamping means for affixing said first body to one of said upright members;

second clamping means for affixing said second body to the other of said upright members; and stationary retainer means provided on each of said bodies for providing engagement of said workpiece at spaced locations and fixing the position of said workpiece;

wherein a rearward portion of each of said first and second bodies is adapted for engagement with its respective upright member, and wherein said stationary retainer means is provided on a forward portion of each of said first and second bodies, and wherein said stationary retainer means comprises an upwardly facing slot formed in each said body, each said slot being provided with an entrance having a sufficient transverse dimension to receive said workpiece therein, and being defined by tapered walls which cooperate to provide a decreasing transverse dimension to said slot toward the lower portion of said body, so that downward movement of said workpiece in the slots formed in said first and second bodies results in engagement of said workpiece with the walls of said slots to frictionally engage said workpiece with said first and second bodies.

9. The assembly of claim 8, wherein each of said bodies comprises a substantially planar member adapted for placement against a side of one of said upright members, and wherein said clamping means comprises a clamping plate adapted for placement against another side of said upright member, and means extending between each said body and its clamping plate for clamping said upright member therebetween and securing said body in position thereon.

10. The assembly of claim 9, further comprising guide means provided on each said body for engaging the upright member to which said body is affixed for providing a predetermined angular orientation of said body relative to said upright member.

* * * * *